US008400301B1

(12) United States Patent
Kersch et al.

(10) Patent No.: US 8,400,301 B1
(45) Date of Patent: Mar. 19, 2013

(54) WINDOW SAFETY AND SECURITY DEVICE

(76) Inventors: Mitchell I. Kersch, Roslyn Hts, NY (US); Aaron R. Kersch, Roslyn Hts., NY (US)

( * ) Notice: Subject to any disclaimer, the term of this patent is extended or adjusted under 35 U.S.C. 154(b) by 0 days.

(21) Appl. No.: 13/543,917

(22) Filed: Jul. 9, 2012

(51) Int. Cl.
*G08B 13/08* (2006.01)

(52) U.S. Cl. ..... 340/547; 340/546; 340/545.1; 340/545.7; 340/429; 340/425.5; 340/541; 340/542; 340/566; 200/61.71; 200/61.73; 200/61.76; 200/61.93

(58) Field of Classification Search ..... 340/547, 340/546, 545.1, 545.7, 429, 566, 426.27, 340/425.5, 541; 200/61.71, 61.73, 61.76, 200/61.93
See application file for complete search history.

(56) References Cited

U.S. PATENT DOCUMENTS

| | | | | |
|---|---|---|---|---|
| 4,495,486 | A * | 1/1985 | White | 340/546 |
| 5,552,768 | A | 9/1996 | Mikiel et al. | |
| 5,971,450 | A * | 10/1999 | Suarez | 292/289 |
| 6,557,611 | B1 * | 5/2003 | Fuentes | 160/10 |
| 6,778,086 | B2 | 8/2004 | Morrone et al. | |
| 2006/0288527 | A1 | 12/2006 | Van Vliet | |

* cited by examiner

*Primary Examiner* — Tai T Nguyen
(74) *Attorney, Agent, or Firm* — John F. Vodopia

(57) ABSTRACT

A window safety and security device detects unauthorized movement of a double-hung window, sliding window, or door upon which the safety and security device is installed and communicates an alarm in response to the detecting. The device includes a housing, a suction cup affixed to or integral with the housing configured to be removably attached to an inside glass pane of a first sash of a double-hung window, sliding window or door. An electrical switch is disposed in, on or affixed to the housing for contacting a portion of a second sash when the second sash is slid to a fixed position to actuate the switch. A light or a buzzer or both communicates a detected window or door movement sufficient to cause a change of state in the switch.

24 Claims, 8 Drawing Sheets

WINDOW SAFETY AND SECURITY DEVICE

BACKGROUND OF THE INVENTION

The present invention relates broadly to safe window operation and more specifically to a window safety and security device and method for using same that notifies persons proximate a window protected by the window safety device that an unauthorized attempt to open or cause unauthorized manipulation to the window is in progress.

Double-hung windows, sliding windows, and doors are known to be left open a small amount to effect ventilation, particularly in warmer weather and climates. A partially open window allows a child an opportunity to open the window further (sufficient for egress) in order to pass. If on ground level, if the child is lucky enough to exit the premises through the window with only an injury, they may wander off and become lost, exposed to automobile traffic, dangerous animals (including humans) and/or other dangers of the world. If at higher levels, injuries as a result of falling may be quite severe and at times fatal. Every year in the United States, nearly 5,000 children, mostly toddlers, fall out of windows and are injured; 28% require a hospital stay and approximately 20 die. A child who falls 10 feet can suffer spinal injuries, paralysis and/or fatal head injuries.

Window guards have been shown to reduce fatal falls by up to 35% as seen in a pilot study in New York City and the nonprofit product testing organization, ASTM International, has established voluntary standards to ensure window guards don't interfere with emergency escape in a fire.

Window guards screw into the side of a window frame and have bars no more than 4 inches apart. They are sold in different sizes for various size windows and adjust for width. Guards must meet requirements for spacing and strength. In a home with young children it is critical that window guards that are installed have a release mechanism so that they can be opened for escape in a fire emergency. Guards that allow for escape in case of emergencies must be difficult for very young children to open.

Parents may also consider using other window safety devices such as window wedges or braces or removing the hand cranks on casement windows. The bottom line is to ensure that windows do not open more than 4 inches. Toddlers have been known to fall out of windows or get trapped in window openings in as little as 5 inches. Parents should be aware that windows provide a means of escape from a burning home, so whatever protection means are used, they need to be able to be easily opened or removed in a fire or other emergency situation. Still, no safety device can take the place of active adult supervision, or notice in case a child attempts to open a window.

U.S. Pat. No. 5,552,768 discloses a portable sliding window lock comprising a molded resilient triangular block with a simple, low-strength, non-locking suction cup securely fastened to its base. A jamming tapered tip on the triangular block is angled slightly upward toward the mounting surface. The sliding window lock is mounted on the vertical surface of a flat window pane adjacent the frame to intercept and jam the window frame with the sliding window partially open. Theoretically, this should prevent forcing the partially open window any further open to gain access (or egress, for that matter). An audible alarm also is included that is mounted on the resilient triangular block and set off by a switch activated by force applied to the window, i.e., a contact switch, motion sensing switch or pressure switch embedded in the molded resilient triangular block.

A problem is that many modern double-hung windows, sliding windows, and doors comprise mechanisms that allow the glass portion to swing out of the slide track for cleaning. In this case, the sliding window or door could then be moved without compelling contact of the sliding window lock with the window frame, essentially rendering useless the portable sliding window lock as a safety device.

Also known is US Patent Appln. Publication No. 2006/0288527, which discloses a door stop formed of a suction cup attached to a body for use on glass sliding doors and windows in a closed or partially open position. The body is configured to tip and press the low-strength, non-locking suction cup down on the glass to prevent sliding, holding the stop assembly in place and an alarm is sounded if the stop is dislodged from the door. In more detail, to apply the stop assembly, it is simply squeezed against the surface of the fixed glass panel near the center of the sliding door or window. If an attempt is made to open the door or window, the movable panel hits the stop assembly and prevents it from opening. An alarm built into the body detects in a case where lateral force dislodges the stop from the door or window.

Like U.S. Pat. No. 5,552,768, discussed above, the stop assembly disclosed in US Patent Appln. Publication No. 2006/0288527 does not prevent the glass portion of a modern window or door to swing out of the slide track for cleaning. In this case, the sliding window or sliding door could then be moved or opened without contacting and being stopped by the stop assembly, essentially rendering useless the stop assembly as a safety device.

U.S. Pat. No. 6,778,086 discloses an open window security lock comprising a compression staff (i.e., compression column) with a simple, low-strength, non-locking suction cup for attaching the staff to a window that allows a double-hung window or sliding window sash to open a small amount for ventilation but not in an amount sufficient to admit an intruder. The compression staff upper end has a switch to sound an alarm if the upper arm is moved away from touching the fixed upper frame, e.g., a motion detector, a displacement detector or a vibration detector. As shown in FIG. 3, part 11 is one member of the compression column staff and it provides an adjustable overall length for the staff by being adjustably joined to adjustable part 12. Parts 14 and 15 are staff ends where part 16 is an electric signalling means for signalling a disturbance on the system by an intruder. That is, once the portable sliding window lock is securely fastened to surface window sash, it further prevents opening of the double-hung window or sliding glass window, by end piece 14. Audio alarm 23 is activated by switch 16 at end 15, contacting the window frame. If the window as shown is closed, the electric button piece extends closing switch 16 and activating alarm 23.

While the open window security lock comprising compression staff operates to block further opening of a window in which it is placed and adjusted to accommodate the desired opening, its use is cumbersome. For that matter, it is likely that piece 18 may be adjusted so that end 14 can be extended far enough off the planar surface of the glass as to allow the lower sash to move underneath and past the end 14 while the staff, attached to the upper glass, remains in place, including switch 16. Moreover, the multiple working parts render the device somewhat complicated and of course increase the cost for manufacture.

SUMMARY OF THE INVENTION

The present invention presents a window safety and security device that overcomes the shortcomings of the known related and previous arts.

Broadly, the inventive window safety and security device comprises a complex, high-strength, locking suction cup device configured with a standoff switch that when allowed to extend activates an alarm. The suction cup is fixed to a window glass of a first sash at a desired open position, relative thereto, for the second sash. The frame end of the second sash contacts and depresses the switch when opened against the suction cup. If the second sash is closed or pulled away from contact with the switch, for example, by pulling the window away from its track, the switch causes the alarm to sound.

In an embodiment, the invention provides a window safety and security device that detects unauthorized movement of a double-hung window, sliding window, or door upon which the safety and security device is installed and communicating an alarm in response to the detecting. The device includes a housing, a suction cup affixed to or integral with the housing configured to be removably attached to an inside glass pane of a first sash of a double-hung window, sliding window, or door which are formed with a first and a second sash. An electrical switch is disposed in, on or affixed to the housing for contacting a portion of the second sash when the second sash is slid to a fixed position to actuate the switch. A means for communication an alarm is included for communicating a condition in which window or door movement from the fixed position causes change of state in the switch, disposed in, on or affixed to the housing.

The means for communicating may be a transmitter that transmits a signal to an alarm and alerting unit or system, or may be a light emitting device. For that matter, the means for communicating may be a sound emitting device or both a light emitting device and a sound emitting device. A battery or wall power adapter are used to provide electrical power to the device(s), i.e., to the switch(es) and the means for communicating. Preferably, an on-off-on switch is electrically connected to the battery or wall power adapter, the electrical switch and the means for communicating, in order to actuate or maintain the aforementioned electrical components or computer chip(s) in a powered or unpowered state. For example, the aforementioned electrical components may be replaced with a single proprietary semiconductor device or controller, such as an FPGA, without deviating from the scope and spirit of the invention.

The window safety and security device body or housing includes a cavity, recess or opening for securely holding one end of an adjustable length safety bar. A point in the circumferential perimeter of the cavity, recess or opening that is closest to a surface of a window or door to which the device is attached (i.e., upon fixation) is configured to stand off from the surface a distance approximately equal to a depth of the suction cup device. In an alternative device, a point in the circumferential perimeter of the cavity, recess or opening that is closest to a surface of a window or door to which the device is attached is configured to stand off from the surface a distance approximately equal to a depth of a sash frame (or door frame) portion plus a distance approximately equal to a depth of the suction cup device.

The adjustable-length safety bar may comprise any bar for placement between two security and safety devices, which when positioned therebetween, and the safety and security devices are affixed to a window glass of respective sliding windows, prevent movement either of the window sashes towards each other. Preferably the bar is two-pieces, where one part telescopes into the other part to affect length adjustment. Any adjustable-length bar known to those of skill in the art may be utilized in the inventive system, without deviating from the scope and spirit of the invention, as long as the bar is fixable or otherwise detachably fixable at its ends to the respective security and safety devices in the uses described broadly herein.

The sliding window may be of the type mounted in a wall to slide vertically up and down or may be of the type mounted in a wall and slides horizontally left and right. The inventive device is also for use wherein the sliding window is a door, the first and second sashes comprise first and second glass door portions that slide on runners horizontally to open and close or swing inward or outward to open and close. For that matter, the windows and doors will typically include a mechanism that allows at least one sash to be displaced inwardly about a frame pivot point for cleaning and maintenance.

In another embodiment, the invention includes a window safety system. The window safety system comprises a first window safety and security device configured to be affixed to a window surface of one sash of a window to be protected that comprises a first sash and a second sash. An adjustable-length safety bar having a first end and a second end, wherein the first end is configured to be abutted against a non-movable part of the window, or a window frame of the window to be protected and wherein the second end is configured to be removably secured to the window safety and security device, at a time at which the window safety and security device is affixed to the window surface of the window to be protected.

The first window safety and security device comprises a body or housing including a cavity, recess or opening for securely holding one end of the adjustable-length safety bar, a suction cup affixed to or integral with the housing configured to be removably attached to an inside window surface of a first sash of the window to be protected, and electrical on-off-on switch for toggling the devices on-off state, an electrical momentary switch disposed in, upon or that is affixed to the housing for contacting a portion of the second sash of the window to be protected, when the second sash is slid to a fixed position to actuate the momentary switch and means for communicating a condition in which window movement from the fixed position causes a detectable change of state in the momentary switch.

The window safety system preferably comprising a second window safety and security device for affixation to a window surface of the second sash, wherein the cavity, recess or opening for securely holding the one end of the safety bar in the first window safety and security device stands off from the surface of the first sash of the window to which it is attached. Also, the adjustable-length safety bar extends between the cavity, recess or opening of the first safety and security device standing off the surface of the first sash and a cavity, recess or opening of the second safety and security device attached to prevent opening movement of the sashes.

In addition, the safety system may further comprise a second window safety and security device for affixation to a window surface of the second sash of the window to which it is attached, wherein the adjustable-length safety bar is substantially "L" or "S" shaped in order to compensate for a difference in distance between a plane of the surface of the first sash and a surface of the second sash and which extends between the cavity, recess or opening of the first safety and security device and a cavity, recess or opening of the second safety and security device to prevent opening movement of the sashes.

Alternatively, the window safety system may include that the second safety and security device is simplified to include only a suction cup device, a suction cup locking device and a cavity recess or opening or an affixed adjustable-length bar.

BRIEF DESCRIPTION OF THE DRAWING FIGURES

The present invention can best be understood in connection with the accompanying drawings. It is noted that the invention is not limited to the precise embodiments shown in drawings, in which:

FIG. 1 presents a front plan view of a double-hung window upon which one embodiment of the safety and security device of the invention is mounted with an optional safety bar or column in place;

FIG. 2A presents a more detailed view of the safety and security device depicted in FIG. 1, also with the optional safety bar or column in place;

Figure 1:
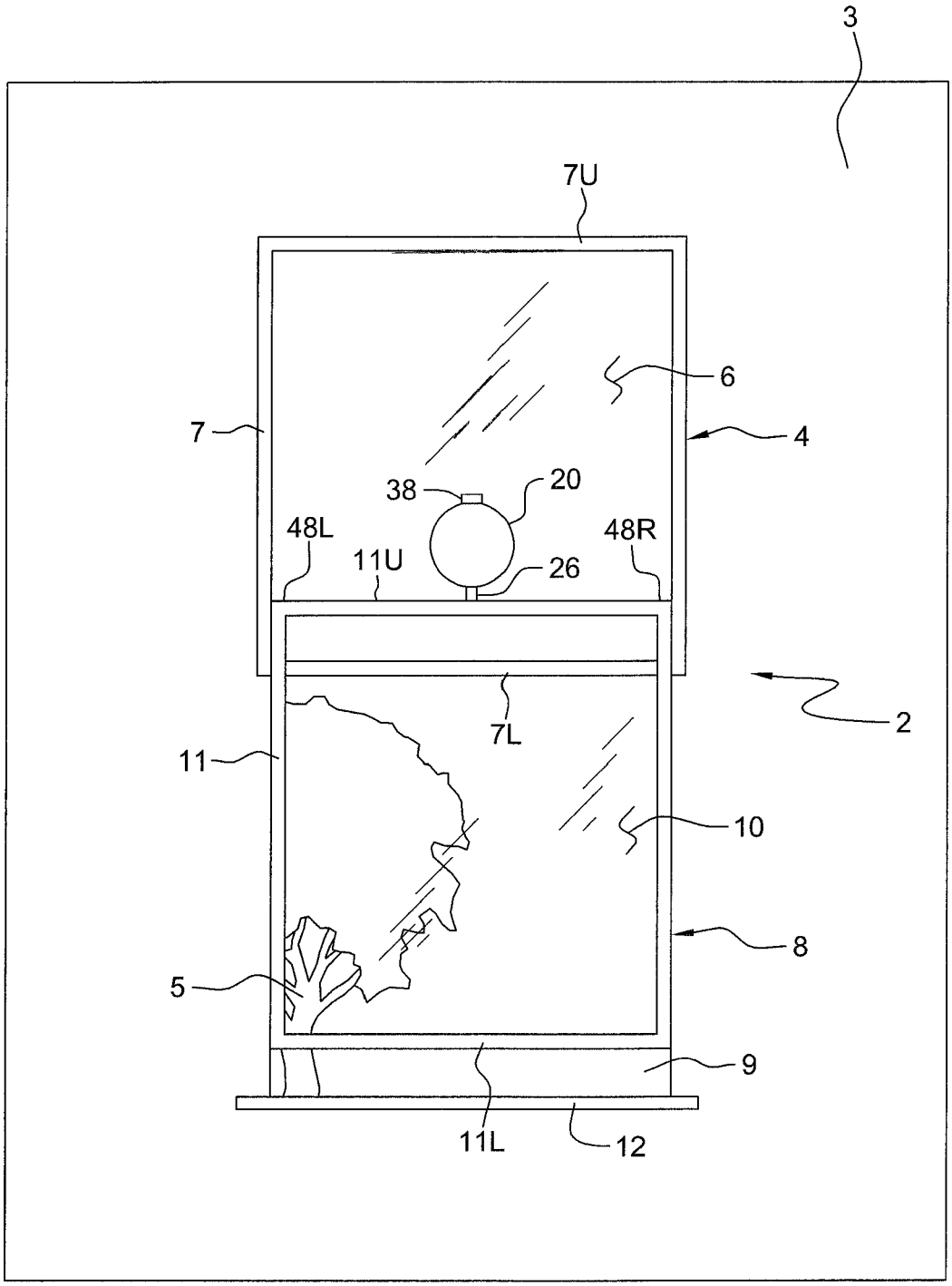
Figure 4A:
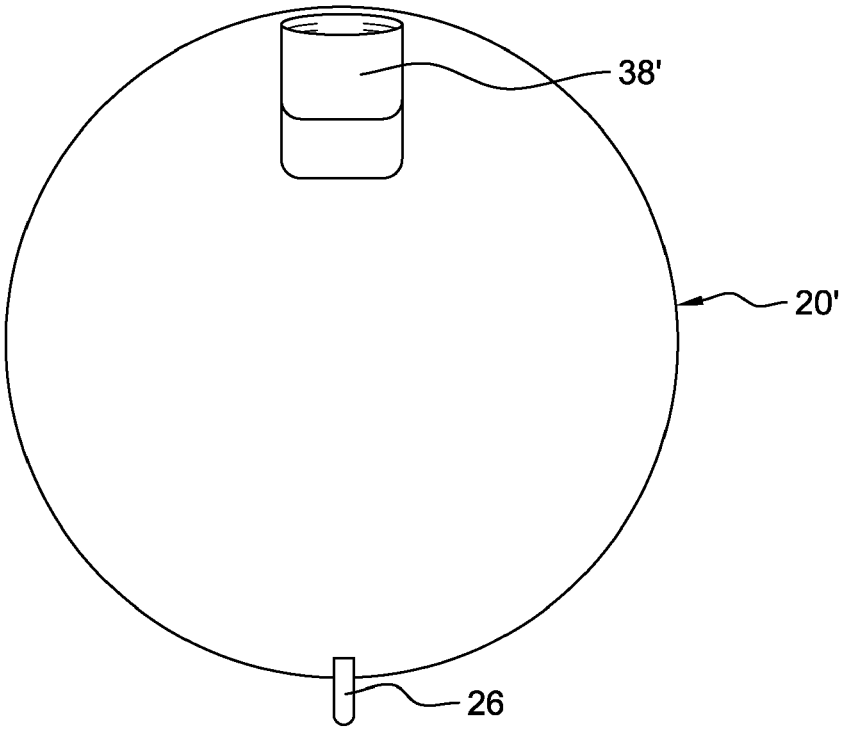
FIG. 4A is an alternative embodiment of the security and safety device of the invention depicted in FIGS. 1, 2.
Figure 4B:
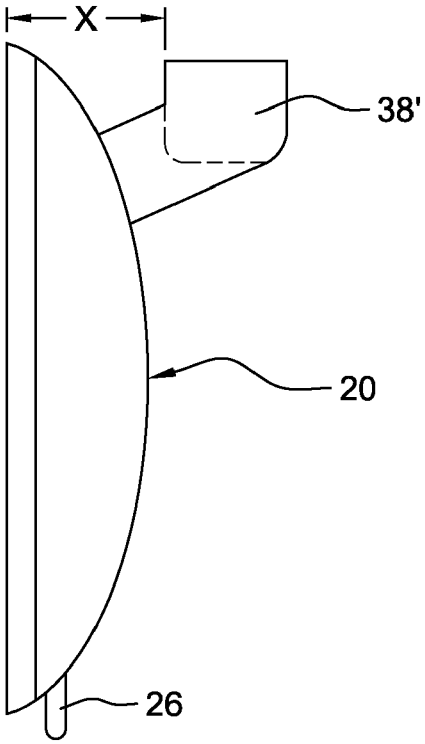
FIG. 4B is a side view of the embodiment depicted in FIG. 4A, highlighting that the recess is configured to standoff from the housing, as compared to the recess of the FIGS. 1, 2 embodiment.
Figure 5A:
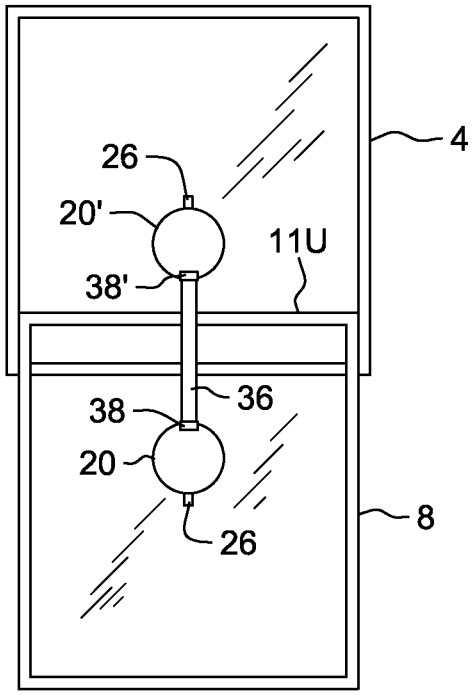
Figure 5B:
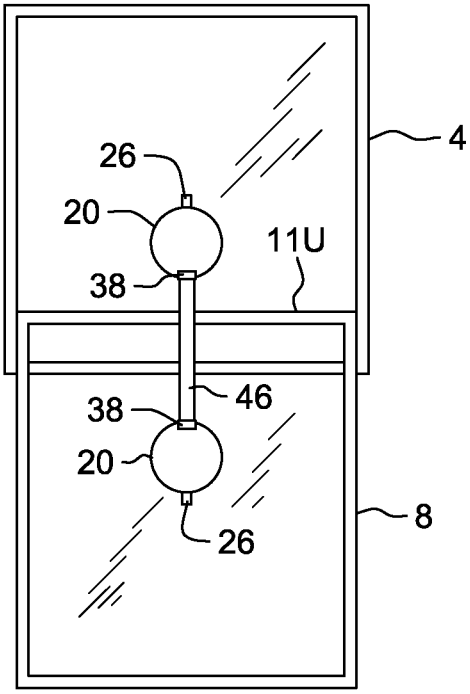
Figure 5C:
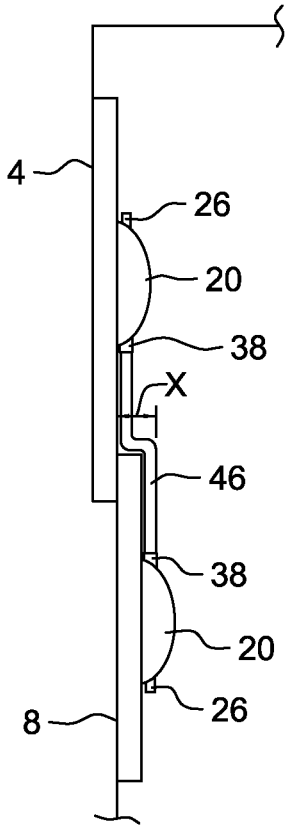
Figure 6A:
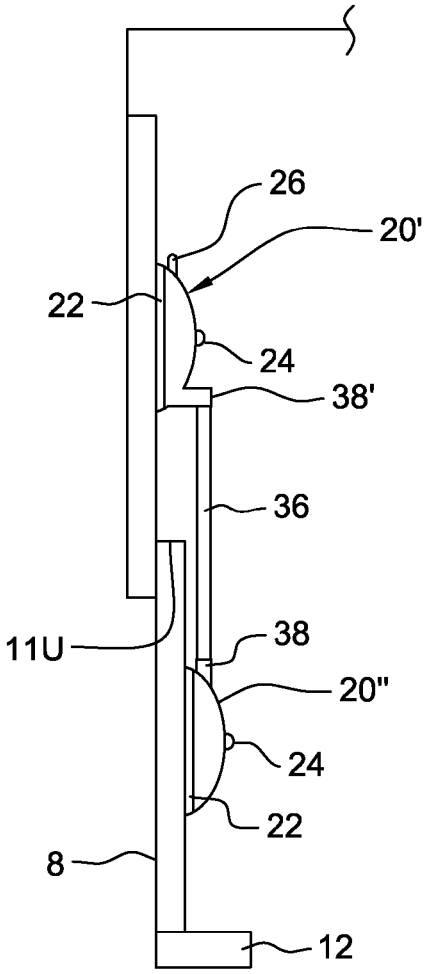
Figure 6B:
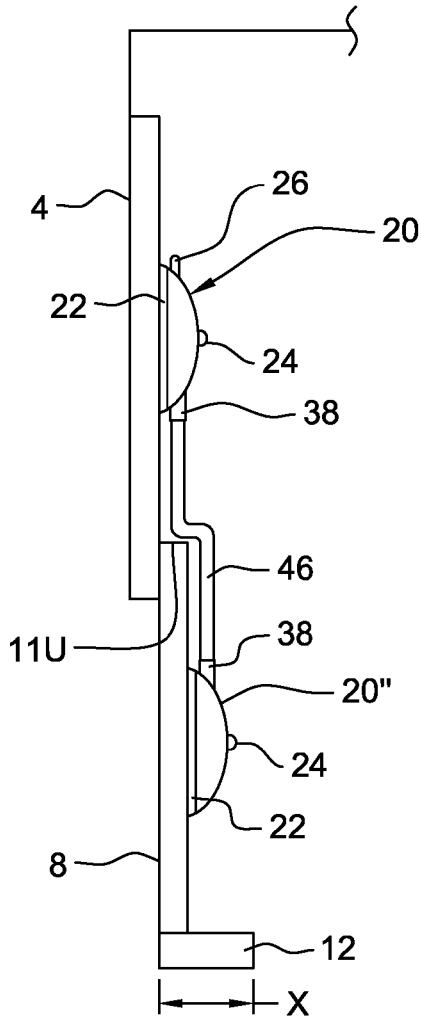
Figure 6C:
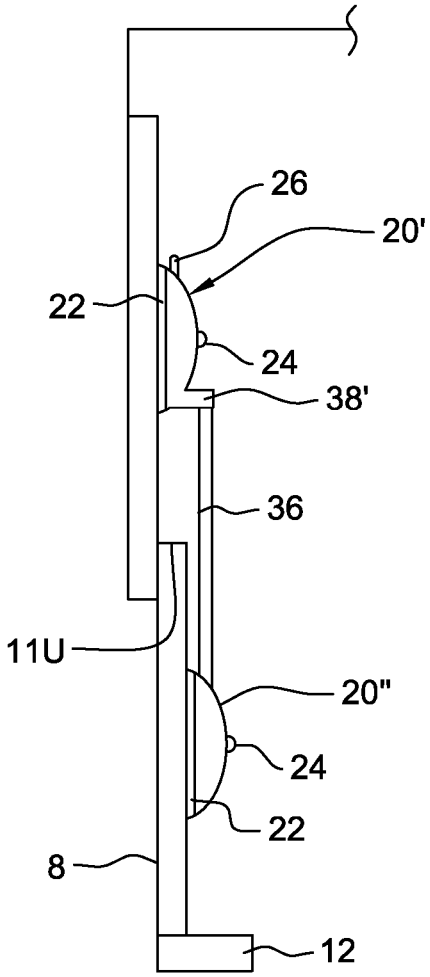
Figure 6D:
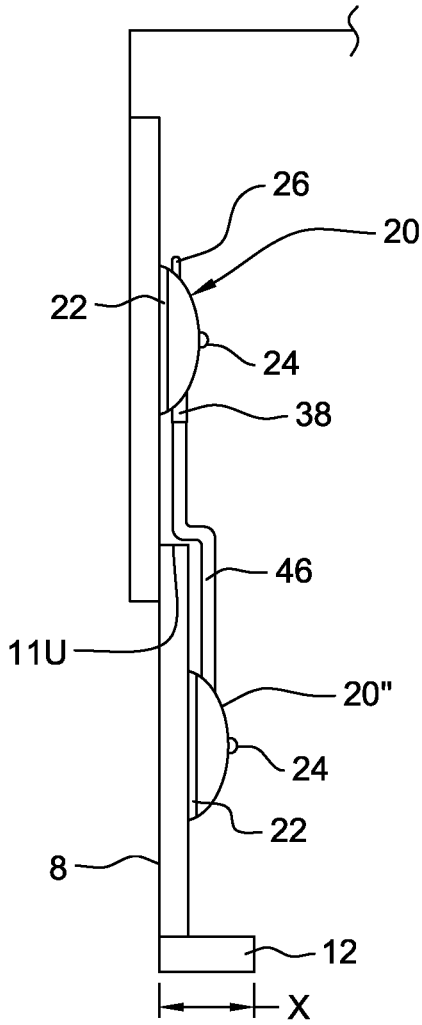

FIG. 5A presents a front plan view of a window safety system mounted on a double hung window, which includes a locking telescopic bar and the safety and security device depicted in FIGS. 4A and 4B;

FIG. 5B presents a front plan view of a window safety system mounted on a double-hung window, which includes the safety and security device depicted in FIGS. 1, 2 and a substantially L-shaped safety bar to accommodate for the offset between the surface of the first and second windows or door sections;

FIG. 5C presents a side view of the window safety system of FIG. 5B embodiment;

FIG. 6A presents a side plan view of an alternative window safety system mounted on a double hung window as shown in FIG. 5A, wherein safety and security device 20 on the lower sash is replaced with a high-strength locking suction cup device including only a simple recess for receiving an end of the safety bar;

FIG. 6B presents a side plan view of an alternative window safety system mounted on a double hung window as shown in FIGS. 5B and 5C, wherein safety and security device 20 on the lower sash is replaced with a high-strength locking suction cup device including only a simple recess for receiving an end of the safety bar;

FIG. 6C presents a side plan view of an alternative window safety system mounted on a double hung window as shown in FIGS. 5B and 5C, wherein safety and security device 20 on the lower sash is replaced with a high-strength locking suction cup device including only an affixed straight adjustable-length safety bar for securing to the safety system on the top sash; and FIG. 6D presents a side plan view of an alternative window safety system mounted on a double hung window as shown in FIGS. 5B and 5C, wherein safety and security device 20 on the lower sash is replaced with a high-strength locking suction cup device including only an affixed L-shaped adjustable-length safety bar for securing to the safety system on the top sash.

DETAILED DESCRIPTION OF THE INVENTION

The following is a detailed description of example embodiments of the invention depicted in the accompanying drawings. The example embodiments are in such detail as to clearly communicate the invention and are designed to make such embodiments obvious to a person of ordinary skill in the art. However, the amount of detail offered is not intended to limit the anticipated variations of embodiments; on the contrary, the intention is to cover all modifications, equivalents, and alternatives falling within the spirit and scope of the present invention, as defined by the appended claims.

In an embodiment, the invention includes a window safety and security device that detects unauthorized movement of a double-hung window, sliding window, or door upon which the safety and security device is installed and communicating an alarm in response to the detecting. The device includes a housing, a suction cup affixed to or integral with the housing configured to be removably attached to an inside glass pane of a first sash of a double-hung window, sliding window, or door which are formed with a first and a second sash. An electrical switch is disposed in, on or affixed to the housing for contacting a portion of the second sash when the second sash is slid to a fixed position to actuate the switch. A light or a buzzer or both are included for communicating a condition in which window or door movement from the fixed position causes change of state in the switch, disposed in, on or affixed to the housing.

FIG. 1 presents a front plan view of a double-hung window 2, mounted in a wall 3, with the window 2 comprising upper and lower sashes 4, 8, upon which one embodiment of the safety and security device 20 of the invention is mounted. Upper sash 4 includes at least one glass 6 (the windows may be double pane) surrounded by a frame 7, including a lower frame 7L. Lower sash 8 includes at least one glass 10 surrounded by a frame 11, including an upper frame 11U. The lower sash 8 of window 2 is partially open, leaving an opening 9 between the lower frame 11L of lower sash 8 and a windowsill 12, as shown (see tree 5 outside of wall 3).

Figure 2A:
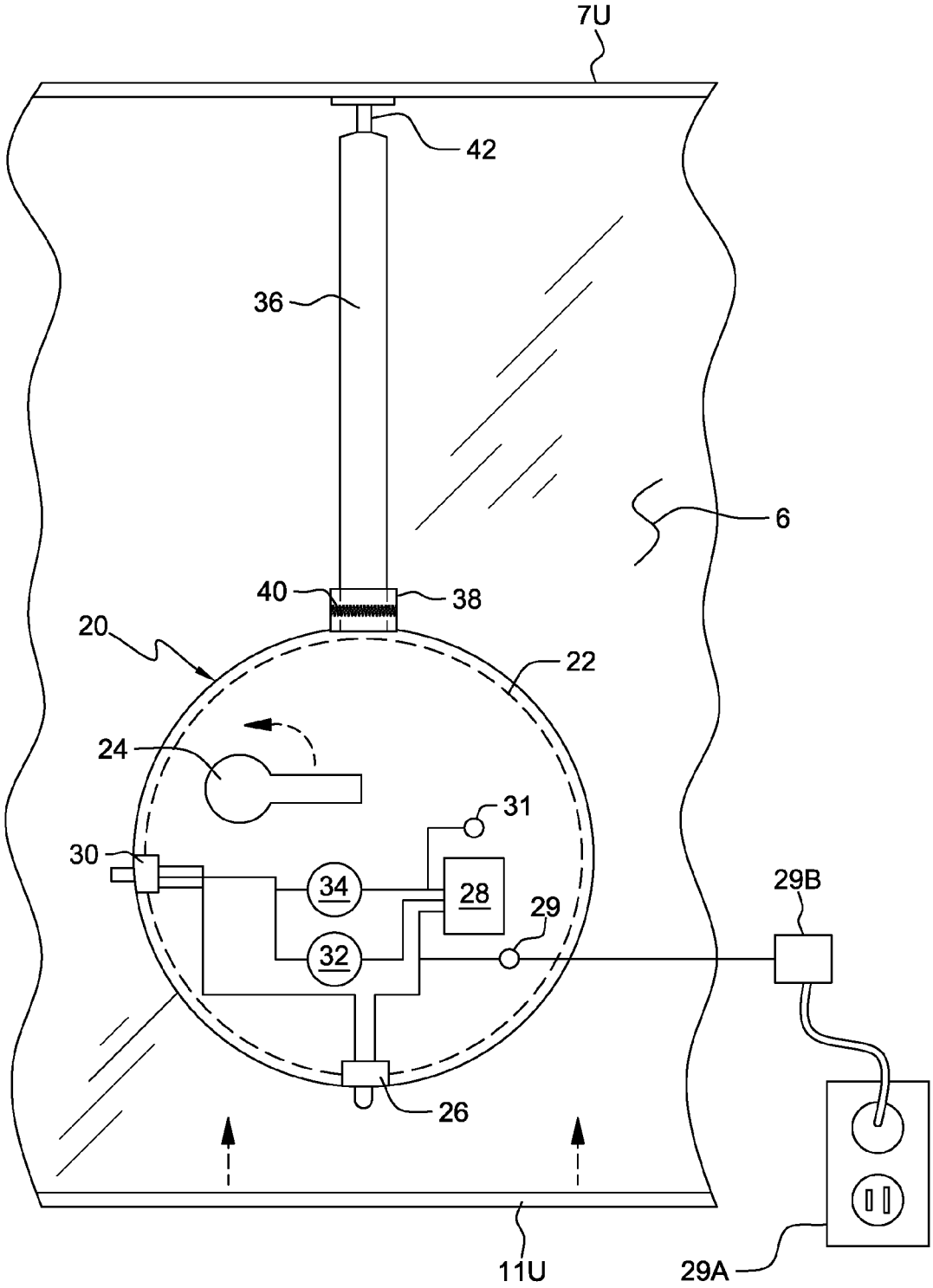
FIG. 2B depicts one form of an adjustable-length safety bar that may be used with a window safety system of the invention.
Figure 2B:
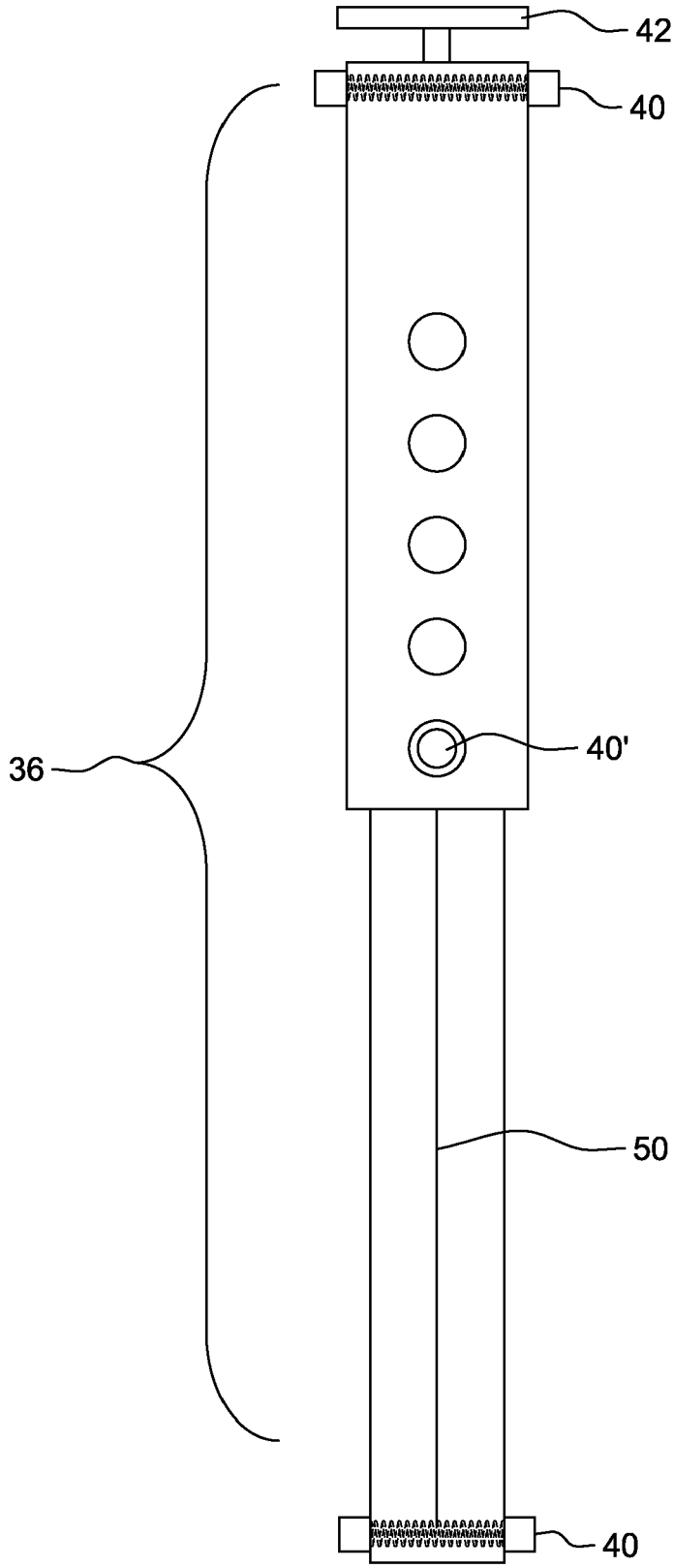
Figure 3:
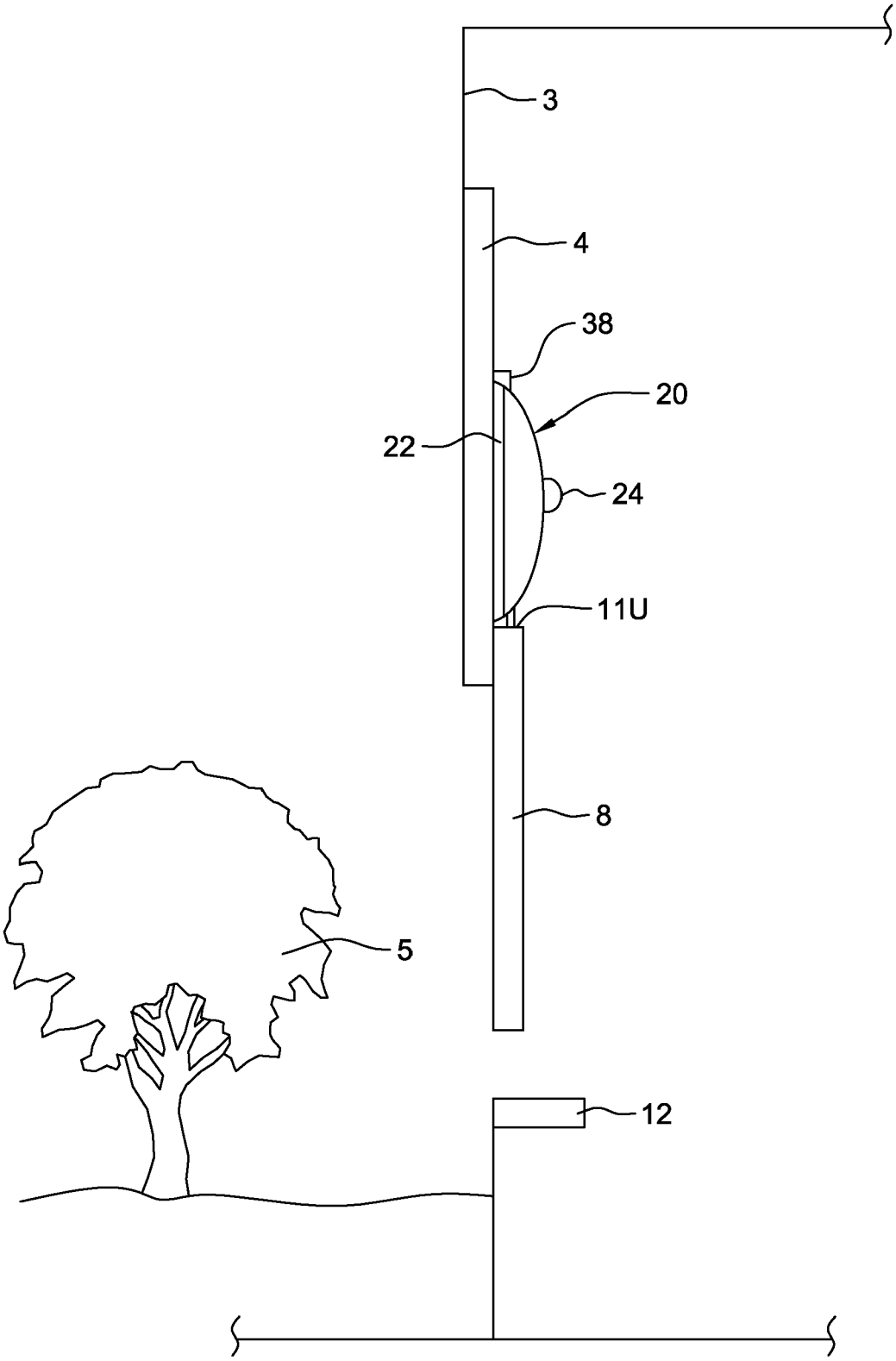
FIG. 3 is a side view of the double-hung window and the safety and security device mounted thereon without the optional safety bar or column in place.

The inventive window safety and security device 20 comprises a housing or body (see FIG. 3), upon which is fixedly attached (or from which is integrally formed) a high-strength locking suction cup 22 (as seen more clearly in FIGS. 2 and 3). The high-strength locking suction-cup 22 is designed to be virtually immobile once placed correctly and locked on the glass 6 of one sash (for example, upper sash 4) of the window 2. Preferably, the safety and security device 20 includes a suction cup lock mechanism 24, extending from the device housing, in a form of a lever or handle for both securely locking and unlocking the suction cup 22.

The safety and security device 20 also includes a normally-closed (or normally-open) momentary switch 26, to detect unauthorized opening or other unauthorized manipulation of one or more of the sashes of the window 2 after the window is positioned in a secured position in cooperation with the window safety and security device 20. The momentary switch 26 is electrically connected to at least one battery 28, or to an AC-based power source 29B via a wall power adapter port 29. AC-based power source is a converter that is connected to an AC power outlet 29A, which converts AC to the DC voltage required to operate the various electrical/electronics devices operational in the safety and security device 20. The momentary switch 26 also is connected to an on-off-on switch 30, which activates/deactivates the feature of the safety and security device 20 by which persons proximate the window 2 are alerted to opening or other unauthorized manipulation. The on-off-on switch also is electrically connected to both an indicator light 32 and a buzzer 34, which light and buzzer are activated if the upper frame 11U of sash 8 moves away from momentary switch 26 of the safety and security device 20. Adjacent to the on-off-on switch 30 (i.e. not directly connected) is a battery-indicator light 31, which includes means for detecting the voltage level of the battery and illuminating when the battery level is detected to fall below a certain level of percentage of available energy/power.

Please note that while the housing or body of the safety and security device 20 is depicted as substantially rounded, it is not limited to any particular shape. The only true limitation is that the momentary switch 26 is able to be placed in or on the body or housing of device 20 (to which the actual suction cup locking device 24 is mounted or integrally formed) in a way that the toggle part 26 of same extends from the device to be depressed for device operation by a frame part of a window when fixed in its desired, partially open position. As described, moving the window away from the device 20, affixed on the window by the suction cup 22 (through action of the suction cup locking device 24) allows the toggle part 26 to move out from it depressed position, which causes an audio alarm to sound, a light to be activated, or both, communicating alarm.

For that matter, while it is preferred that the battery 28, on-off-on switch 30, battery-indicator light 31, light 32 and buzzer 34, and any wiring and/or computer chip(s) be maintained within one or more cavities or recesses formed in the body or housing of safety and security device 20, these elements also can be attached to an outer, non-window-contacting surface of the safety and security device 20, without deviating from the scope and spirit of the invention. That is, the device 20 may be configured solely as a suction cup 22 with some type of upper surface and a suction cup locking device 24 as long as the electrical/electronic components, particularly momentary switch 26, light, buzzer and power source are mounted or otherwise affixed to the device to facilitate intended operation.

To operate the safety and security device 20, for example, in a window 2 such as shown in FIG. 1, a user places and secures the device 20 upon a portion of the glass 6 of the upper sash window 4 (using lock device 24). The lower sash 8 is then moved up until the upper frame 11U contacts and depresses the toggle part of the momentary switch 26 (resulting in a partially open position). The user then activates the safety and security device 20 using on-off-on switch 30. Thereafter, if the lower sash 8 is moved away from the device 20 in such a way that the upper frame 11U ceases its contact with the momentary switch 26, allowing free extension, which causes it to toggle, the circuit paths between the power source (28, 29B) and the light 32 and/or buzzer 34 are closed, lighting the light 32 and causing the buzzer 34 to emit an audible sound, as respective alarms/alerts. Such movement can occur where a child or uninvited guest moves the upper or lower sashes up or down, or snap the lower sash out of its track using latch mechanisms 48L and 48R, normally employed for cleaning.

An embodiment of a window safety system of the invention is shown in FIGS. 2A, 2B and 3. The window safety system includes both a safety and security device 20 (as shown in FIG. 1) and an adjustable-length safety bar or tube 36. Safety bar 36 acts to prevent further opening the window 2 when the bar is fixed to the safety and security device 20 and wedged up against a fixed structure, such as the upper frame 7U of the upper sash 4, or the frame portion of the window opening in the wall 3. An opening, cavity or recess 38 is included or built into the body or housing of the safety and security device 20 for receiving one end of the safety bar 36. For that matter, the opening, cavity or recess 38 preferably includes a spring-loaded mechanism 40 for locking the end of the bar in place as the anchor.

Most preferably, the safety bar 36 includes a bolt 42, at the opposite end of the bar (opposite the spring-loaded mechanism 40), for adjusting the length of the bar (to extend or shorten) on a minor scale (i.e. no more than several inches), where necessary. The bolt is removably attached to the end of the bar, by any means known to the skilled artisan. For example, the bolt 42 may be screwed into an end of the bar so that a length of the bolt extending from the bar is defined by how far a bolt shaft is screwed into the bar. Hence, the safety bar 36 may be used, where desired, without the bolt 42 engaged at one end.

During use, the safety bar 36 (opposite the end with bolt 42, which is preferably padded) is inserted into the safety and security device 20 before the device 20 is put in place on the window surface. The end of the safety bar 36 with the bolt 42 is then wedged against the window frame 11U and the device is then fixed to the window surface. If the bolt 42 is installed, the bolt may be turned to advance its length extending from the end of the bar, for a more accurate fit between the device 20 and upper part 7U. The lower window 8 may then be moved up towards the device 20 until the frame part 11U contacts and toggles momentary switch 26 to open the circuit between the light 32 and buzzer 34, and the on-off-on switch 30 is activated to "arm" the device.

Alternatively, a two-piece adjustable-length safety bar may be used, a second piece of which extends telescopically from a first piece, a total length of which being fixed using a bar locking mechanism as shown in FIG. 2B. The bar locking mechanism 40' for locking the telescopic bar is similar to the locking mechanism used to anchor the safety bar 36 to the safety and security device 20 with the only difference being a single spring-loaded clip as opposed to a double spring-loaded clip as used in the anchor 40 and functions to lock the two pieces into place thereby defining a fixed length of the bar. Running down the center of the entire inner bar will be a line or groove 50 to indicate where the locking mechanism is for easier use.

Please note that the invention as shown in FIGS. 1-3 is meant only to convey the inventive concept, but not to limit the invention in any way. For example, the inventive safety and security device 20 may be used with any known windows, whether they open and close vertically or horizontally, with horizontally sliding doors, doors other than sliding doors, etc. without limitation. Moreover, the safety and security device 20 is not intended to be limited to the orientation shown, but may be flipped 180 degrees, 90 degrees or any variation between 0 and 360 degrees to accommodate any use considered by a user.

In an alternative configuration, the invention provides a window safety system (FIGS. 5A, 5B, 5C) including two safety and security devices for mounting on the upper and lower windows, respectively, with an adjustable-length safety bar 36 fixed in position therebetween to prevent the lower window from being raised (or door from being further opened). Because the window or glass surfaces of the upper and lower window sashes, or doors, are inherently positioned in different planes (which are coplanar but separated by an amount equal to the depth of the window sashes, or depth of a door), the alternative configuration accounts for the different depths in order to ensure that the safety bar 36 may extend between the two devices substantially in parallel with the planar surfaces of both windows or doors.

FIGS. 4A and 4B together show a safety and security device 20' formed with a recess with standoff 38' that receives one end of the adjustable-length safety bar 36 at a location away from the surface to which the device is attached at least an amount "x" (FIG. 4B). Amount "x" of device 20' in FIG.

4B is equivalent to the depth of the window or door frame (for example, the depth of sash frame 11U), plus another amount equal to a depth of the suction device 22. The standoff enables a user to place one safety and security device 20' on the glass of the upper sash 4 such that the recess, cavity or opening 38' for receiving safety bar 36 faces down, and to place safety and security device 20, on the glass of the lower sash 8 such that the recess, cavity or opening 38 for receiving adjustable-length safety bar 36 faces up, substantially in alignment with the positioned opening, cavity or recess 38'. The adjustable-length safety bar 36 preferably is inserted snugly at each end into the respective recesses, cavities or openings 38, 38'. In such operation, the on-off-on switch 30 may be maintained in an off position, as the two devices and bar only are effective against any window movement, without alarm.

FIG. 5A shows device 20' affixed to a glass surface of upper sash 4, where one end of adjustable-length safety bar 36 is inserted into the recess with standoff 38'. The other end of adjustable-length safety bar 36 is inserted within and fixed to a recess 38 of a second device 20, as shown. With the bar 36 inserted into the respective recesses 38' and 38 of locking devices 20' and 20, respectively, window 8 cannot be raised without unlocking one or both or the devices. Please note that in the window safety system depicted in FIG. 5A, the alarm is not actuated.

An alternative embodiment is shown in FIGS. 5B and 5C, where the window safety system operates with an adjustable, substantially L-shaped safety bar 46, avoiding a need for separate devices 20, 20'. That is, the L-shaped bar 46 provides for and compensates for the difference in depth of the planar surfaces of the first and second sashes (4, 8), approximately equal to a depth of the sash or door frame. FIGS. 5B and 5C show a window safety system having a first device 20 attached to a surface of upper sash 4 and a second device 20 attached to a surface of lower sash 8. L-shaped adjustable length safety bar 46 is positioned between the two devices, whereas a length of the bar 46 extending parallel to the surface of lower sash 8 is set off an amount "x" from a length of the bar 46 extending parallel to the surface of the upper sash 4 (FIG. 5C). This avoids the need to have two different safety and security devices, for example, a first device 20' and a second device 20, as depicted in the embodiment of FIGS. 4A, 4B, 5A.

In an alternative configuration to the window safety system depicted in FIGS. 4A, 4B, 5A, 5B and 5C, the systems shown in FIGS. 6A and 6B include a simplified safety and security device 20" affixed to lower sash 8 that is much simpler and, therefore, much cheaper to manufacture than the safety devices 20 and 20'. That is, simplified safety and security device 20" essentially comprises a suction cup device 22, a suction device locking mechanism 24 and a recess 38, with nothing else, i.e., no electrical or electronic devices, activating mechanisms or switches, etc., as are included in devices 20 and 20'.

In the FIG. 6A embodiment, a first device 20' with opening, cavity or recess 38' is positioned on the surface of the window glass of upper sash 4 in order to set off and maintain that part of adjustable length safety bar 36 extending from the recess 38' associated and proximate the upper sash 4. The other end of the adjustable-length safety bar 36 is inserted in a recess 38 of the simplified safety and security device 20", as shown in FIG. 6A. The recess, cavity or opening 38' of first device 20' for receiving the adjustable-length safety bar 36 faces down and the recess 38 of the simplified safety and security device 20" faces up, with the length of the safety bar 36 extending therebetween substantially in parallel to the planes of both the upper and lower sashes (4, 8).

In the FIG. 6B embodiment, L-shaped adjustable safety bar 46 is used instead of safety bar 36, obviating a need for a first device 20' with recess standoff 38'. That is, in the window safety system of FIG. 6B, a first device 20 with opening, cavity or recess 38 is positioned on the surface of the window glass of upper sash 4. A first part of L-shaped bar 46 is inserted in the recess 38 and extends down in parallel with the plane of the window until it is required to extend perpendicularly out of the plane of the first window an amount approximately equal to "x". At "x", the length of the bar 46 again turns perpendicularly to extend parallel to the surface or and coplanar with a plane of the window surface of the lower sash 8 and is inserted at its end into recess 38 of the simplified safety and security device 20" (FIG. 6B).

In the FIG. 6C embodiment, a first device 20' with opening, cavity or recess 38' is positioned on the surface of the window glass of upper sash 4 in order to set off and maintain that part of adjustable length safety bar 36 extending from the recess 38' associated and proximate the upper sash 4. The other end of the adjustable-length safety bar 36 is affixed to the simplified safety and security device 20", as shown in FIG. 6C. The recess, cavity or opening 38' of first device 20' for receiving the adjustable-length safety bar 36 faces down, with the length of the safety bar 36 extending there between substantially in parallel to the planes of both the upper and lower sashes (4, 8).

In the FIG. 6D embodiment, L-shaped adjustable safety bar 46 is used instead of safety bar 36, obviating a need for a first device 20' with recess standoff 38'. That is, in the window safety system of FIG. 6D, a first device 20 with opening, cavity or recess 38 is positioned on the surface of the window glass of upper sash 4. A first part of L-shaped bar 46 is affixed to the simplified safety and security device 20" and extends upwards in parallel with the plane of the window until it is required to extend perpendicularly inward towards the upper sash an amount approximately equal to "x". At "x", the length of the bar 46 again turns perpendicularly to extend parallel to the surface or and coplanar with a plane of the window surface of the upper sash 4 and is inserted in the recess 38 of the primary safety and security device 20 (FIG. 6B).

The recess, cavity or opening 38 of first device 20 for receiving the adjustable-length safety bar 36 faces down and the recess 38 of the simplified safety and security device 20" faces up, with the length of the bar 46 extending therebetween in two parts, i.e., one part substantially in parallel and proximate the plane of the surface of upper sash and the other part substantially in parallel and proximate the plane of the surface of the lower sash 8, the two parts connected by a portion extending substantially perpendicular to the axial lengths of both parts of a length "x". Please note that the adjustable-length safety bar 46 includes a mechanism that enables both parts of the L-shaped bar to be adjustable in length.

In operation, the on-off-on switch 30 of device 20 is maintained in an off position, as the two devices 20, 20" and safety bar 36 or 46 only are effective against any window movement, without alarm.

The following list of reference signs of various elements mentioned above is included (as follows), for ease of explanation:

| | |
|---|---|
| 2 | sliding window |
| 3 | wall in which window is positioned |
| 4 | upper sash |
| 5 | tree |
| 6 | glass (upper sash) |

-continued

| | |
|---|---|
| 7 | frame (upper sash) |
| 7U | upper frame |
| 7L | lower frame |
| 8 | lower sash |
| 9 | partial opening |
| 10 | glass (lower sash) |
| 11 | frame (lower sash) |
| 11U | upper frame |
| 11L | lower frame |
| 12 | windowsill |
| 20 | safety and security device |
| 20' | safety and security device with standoff recess for safety bar |
| 20" | simplified safety and security device |
| 22 | suction cup |
| 24 | suction cup locking device |
| 26 | momentary switch |
| 28 | battery |
| 29 | power adapter port |
| 29A | power outlet (AC) |
| 29B | AC-based power source |
| 30 | on-off-on switch |
| 31 | battery indicator light |
| 32 | indicator light |
| 34 | buzzer |
| 36 | adjustable-length safety bar |
| 38 | cavity, recess or opening for receiving bar |
| 38' | recess with standoff |
| 40 | double spring loaded mechanism for locking safety bar in place |
| 40' | single spring loaded mechanism for locking safety bar |
| 42 | bolt for fine adjustment of length of adjustable-length locking bar |
| 46 | L-shaped adjustable-length safety bar |
| 48 | Llatch mechanism left |
| 48R | latch mechanism right |
| 50 | line or groove running down center of safety bar |

In the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present invention.

It is further known that other modifications may be made to the present invention, without departing the scope of the invention, as noted in the appended Claims.

What is claimed is:

1. A window safety and security device for detecting unauthorized movement of a double-hung window, sliding window, or door upon which the safety and security device is installed and communicating an alarm in response to the detecting, comprising:

a single, high-powered suction cup with a housing, the suction cup configured to be removably attached to an inside glass pane of a first sash of a double-hung window, sliding window, or door comprising a first and a second sash;

an first electrical switch disposed in, on or affixed to the suction cup housing for "arming" and "disarming" (turning on and turning off) the safety and security device;

a second electrical switch disposed in, on or affixed to the suction cup housing for contacting a portion of the second sash when the second sash is slid to a fixed position to press against and actuate the second switch; and means for communicating an alarm condition in which window movement from the fixed position ceases to press the second sash against the second switch and causes a change of state in the second switch, wherein the means for communicating is disposed in, on or affixed to the suction cup housing.

2. The window safety and security device as set forth in claim 1, wherein the means for communicating is a transmitter that transmits a signal to an alarm and alerting unit or system.

3. The window safety and security device as set forth in claim 1, wherein the means for communicating is a light emitting device, a sound emitting device or both.

4. The window safety and security device as set forth in claim 1, further comprising a battery or wall power adapter connected to the second switch and the means for communicating.

5. The window safety and security device as set forth in claim 4, further comprising an on-off-on switch electrically connected to the battery or wall power adapter, the second electrical switch and the means for communicating.

6. The window safety and security device as set forth in claim 1, wherein the suction cup housing includes a cavity, recess or opening for securely holding one end of an adjustable-length safety bar.

7. The window safety and security device as set forth in claim 6, wherein a point in a circumferential perimeter of the cavity, recess or opening that is closest to a surface of a window to which the device is attached is configured to stand off from the surface a distance approximately equal to a depth of the suction cup device.

8. The window safety and security device as set forth in claim 6, wherein a point in the circumferential perimeter of the cavity, recess or opening that is closest to a surface of a window to which the device is attached is configured to stand off from the surface a distance approximately equal to a depth of a sash frame portion plus a distance approximately equal to a depth of the suction cup device.

9. The window safety and security device as set forth in claim 1, wherein the double hung window is mounted in a wall and slides vertically up and down.

10. The window safety and security device as set forth in claim 1, wherein the sliding window is mounted in a wall and slides horizontally left and right.

11. The window safety and security device as set forth in claim 1, wherein the sliding window is a door, the first and second sashes comprise first and second glass door portions that slide on runners horizontally to open and close.

12. The window safety and security device as set forth in claim 1, wherein the sliding window is a door, the first and second sashes comprise first and second glass door portions that swing inward or outward to open and close.

13. The window safety and security device as set forth in claim 1, wherein the sliding window includes a mechanism that allows at least one sash to be displaced inwardly about a frame pivot point for cleaning and maintenance.

14. A window safety system, comprising:

a first window safety and security device configured to be affixed to a window surface of one sash of a window to be protected that comprises a first sash and a second sash;

an adjustable-length safety bar having a first end and a second end, wherein the first end is configured to be abutted against a non-movable part of the window, or a window frame of the window to be protected and wherein the second end is configured to be removably secured to the window safety and security device, at a time at which the window safety and security device is affixed to the window surface of the window to be protected;

wherein the first window safety and security device comprises:

a singe, high-powered suction cup with a body or housing including a cavity, recess or opening for securely holding one end of the adjustable-length safety bar, the suction cup configured to be removably attached to an inside window surface of a first sash of the window to be protected;

an electrical momentary switch disposed in, upon or that is affixed to the suction cup housing for contacting a portion of the second sash of the window to be protected, when the second sash is slid to a fixed position to press against and actuate the momentary switch; and means for communicating a condition in which window movement from the fixed position ceases to press the second sash against the momentary switch and causes a detectable change of state in the momentary switch.

15. The window safety system as set forth in claim 14, further comprising a second window safety and security device for affixation to a window surface of the second sash, wherein a cavity, recess or opening for securely holding the one end of the safety bar in the first window safety and security device stands off from the surface of the first sash of the window to which it is attached, and wherein the adjustable-length safety bar extends between the cavity, recess or opening of the first safety and security device standing off the surface of the first sash and a cavity, recess or opening of the second safety and security device attached to prevent opening movement of the sashes.

16. The window safety system as set forth in claim 15, wherein the second safety and security device is simplified to include only a suction cup device, a suction cup locking device and a cavity recess or opening.

17. The window safety system as set forth in claim 14, further comprising a second window safety and security device for affixation to a window surface of the second sash of the window to which it is attached, wherein the adjustable-length safety bar is substantially "L" or "S" shaped in order to compensate for a difference in distance between a plane of the surface of the first sash and a surface of the second sash and which extends between a cavity, recess or opening of the first safety and security device and a cavity, recess or opening of the second safety and security device to prevent opening movement of the sashes.

18. The window safety system as set forth in claim 17, wherein the second safety and security device is simplified to include only a suction cup device, a suction cup locking device and a cavity recess or opening.

19. The window safety system as set forth in claim 14, further comprising a second window safety and security device for affixation to a window surface of the second sash, wherein a cavity, recess or opening for securely holding the one end of the safety bar in the first window safety and security device stands off from the surface of the first sash of the window to which it is attached, and wherein the adjustable-length safety bar is affixed to the second safety and security device and extends to the cavity, recess or opening of the first safety and security device standing off the surface of the first sash to prevent opening movement of the sashes.

20. The window safety system as set forth in claim 19, wherein the second safety and security device is simplified to include only a suction cup device and a suction cup locking device, wherein some portion of the suction cup device is affixed to the safety bar.

21. The window safety system as set forth in claim 14, further comprising a second window safety and security device for affixation to a window surface of the second sash of the window to which it is attached, wherein the adjustable-length safety bar is substantially "L" or "S" shaped in order to compensate for a difference in distance between a plane of the surface of the first sash and a surface of the second sash and which is affixed to the second safety and security device and extends to the cavity, recess or opening of the first safety and security device to prevent opening movement of the sashes.

22. The window safety system as set forth in claim 21, wherein the second safety and security device is simplified to include only a suction cup device and a suction cup locking device, wherein some portion of the suction cup device is affixed to the safety bar.

23. A window safety and security device for detecting unauthorized movement of a double-hung window upon which the safety and security device is installed, comprising:

a single, high-powered suction cup configured to be removably attached to an inside glass pane of a first sash of a double-hung window comprising a first and a second sash;

an first electrical switch with an actuator button arranged on the suction cup, wherein the actuator button is actuated when contacted and depressed by a portion of the second sash pressing against the actuator button when the second sash is slid to a fixed position abutting the first electrical switch;

an adjustable length security bar with a first and a second end, the security bar configured to be detachably held at the first end by the suction cup, with the second sash in the fixed position, as a length of the security bar is adjusted to abut the second end against a non-movable part of the window or window frame in order to hold the security bar between the suction cup and non-movable part and prevent second sash movement in a direction towards the non-movable part; and means for communicating an alarm condition, the alarm condition occurring when a second sash movement from the fixed position in a direction away from the non-movable part causes the second sash portion to cease pressing against and releases the actuator button such that the electrical switch is no longer actuated;

wherein the means for communicating is arranged on the suction cup; and wherein the security bar is detachably held at a portion of the suction cup that is opposite a portion of the suction at which the actuator button is located.

24. The window safety and security device as set forth in claim 23, further comprising a second electrical switch arranged on the suction cup and configured for enabling operation of the device when set to a first position and preventing operation of the device when set to a second position and wherein the suction cup includes a cavity in which the first end of the safety bar is inserted during intended operation.

* * * * *